US005575471A

United States Patent [19]

Robinson et al.

[11] Patent Number: 5,575,471

[45] Date of Patent: Nov. 19, 1996

[54] TABLE TENNIS APPARATUS

[76] Inventors: Stephen W. Robinson, 327 Capital Ave., NE., Battle Creek, Mich. 49017; Michael W. Robinson, 3836 Mt. Olivet, Kalamazoo, Mich. 49004

[21] Appl. No.: 428,557

[22] Filed: Apr. 25, 1995

[51] Int. Cl.[6] ..... A63B 67/04

[52] U.S. Cl. ..... 273/30; 273/29 A

[58] Field of Search ..... 273/30, 29 A

[56] References Cited

U.S. PATENT DOCUMENTS

| | | | |
|---|---|---|---|
| 2,066,724 | 1/1937 | Forsyth . | |
| 2,313,701 | 3/1943 | White | 273/30 |
| 2,333,098 | 11/1943 | Forsyth | 273/30 |
| 3,088,735 | 5/1963 | Clark | 273/30 |
| 3,968,967 | 7/1976 | Nally | 273/30 |
| 4,026,551 | 5/1977 | Larson | 273/30 |
| 4,030,734 | 6/1977 | Castellucci . | |
| 4,134,585 | 1/1979 | Semon | 273/30 |
| 4,772,018 | 9/1988 | Inniger . | |
| 5,178,385 | 1/1993 | Barbador . | |
| 5,354,051 | 10/1994 | Fehrenbach | 273/30 |

FOREIGN PATENT DOCUMENTS

| | | | |
|---|---|---|---|
| 2504808 | 11/1982 | France | 273/30 |
| 203516 | 9/1923 | United Kingdom . | |
| 473665 | 4/1937 | United Kingdom | 273/30 |
| 489225 | 7/1938 | United Kingdom | 273/30 |
| 1577227 | 10/1980 | United Kingdom . | |

OTHER PUBLICATIONS

Bonus Boards The "New Dimension" Game Literature.

*Primary Examiner*—Theatrice Brown
*Attorney, Agent, or Firm*—Price, Heneveld, Cooper, DeWitt & Litton

[57] ABSTRACT

A table tennis game apparatus comprises a horizontal playing surface supported at a preselected height, and one or more upright rebounding panels mounted centrally at the marginal edges of the playing surface. The rebounding panels are provided with a plurality of distinct surfaces of differing hardnesses or differing textures, to provide for varying speeds and/or spins of rebound or ricochet. The surfaces may be positioned at angles with respect to each other to provide for different rebounding angles. The rebounding panels may be positioned with respect to the playing surface so as to be movably adjustable in towards or away from the playing surface. The rebounding panels require greater degrees of skill and strategy beyond that required in the traditional table tennis game, thus adding to the level of enjoyment and competition.

21 Claims, 3 Drawing Sheets

TABLE TENNIS APPARATUS

BACKGROUND OF THE INVENTION

The present invention relates to a modified Ping-Pong® type table or table tennis game, and more particularly, to a game which requires special skills and strategies not required in ordinary table tennis games, thus adding to the level of enjoyment and competition.

In the traditional Ping-Pong® or table tennis game, paddles are used by participants to hit a ball back and forth over a net extending across a horizontal table surface. The ball can be allowed to bounce once on the table before being returned over the net by one player towards the other player, who may allow the ball to touch the table surface once before returning it in a like fashion. Points are won by one player if the other player hits the ball into the net or off of the table, if the ball bounces twice on the other player's side before it is returned, or if the other player is otherwise unable to successfully return the ball. Although this game is widely enjoyed by many people and can be extremely competitive depending upon the skill level of the participants, various attempts have been made to make the game more challenging or more interesting.

One such modification involves playing one or more vertical side walls along the sides of a traditional Ping-Pong® table. In play, the ball is hit off one of the side walls and then over to the opponent's side, rather than traveling directly over the net to the opponent. While such a variation does serve to alter the game, these side walls merely provide an alternate rebounding or ricochet surface. The ball typically rebounds off the side walls in a relatively predictable fashion, and at a speed that is usually the same speed as if the ball had been bounced off of the regular horizontal table surface.

Therefore, a need exists for a modified table tennis game that requires an even greater degree of skill and strategy, thereby increasing the level of enjoyment and competition involved in playing the game.

SUMMARY OF THE INVENTION

In the present invention, a modified table tennis or Ping-Pong® game is provided which increases the degree of difficulty involved in playing, and the amount of skill and strategy necessary to successfully play, thereby increasing the level of enjoyment and competition. The game comprises attaching one or more rebounding panels to a conventional Ping-Pong® table or the like. The side boards have surfaces of different hardnesses and/or textures, to provide for varying the speed and/or spins of rebound or ricochet. The rebounding surfaces may be positioned at angles with respect to one another, to provide for different rebounding angles.

In another aspect of the invention, the rebounding panels are movably attached to a Ping-Pong® table or the like, to provide for adjustment of the rebounding panels towards or away from the horizontal playing surface.

These and other features, advantages and objects of the present invention will be further understood and appreciated by those skilled in the art by reference to the following specification, claims and appended drawings.

DETAILED DESCRIPTION OF THE PREFERRED EMBODIMENTS

Figure 7:
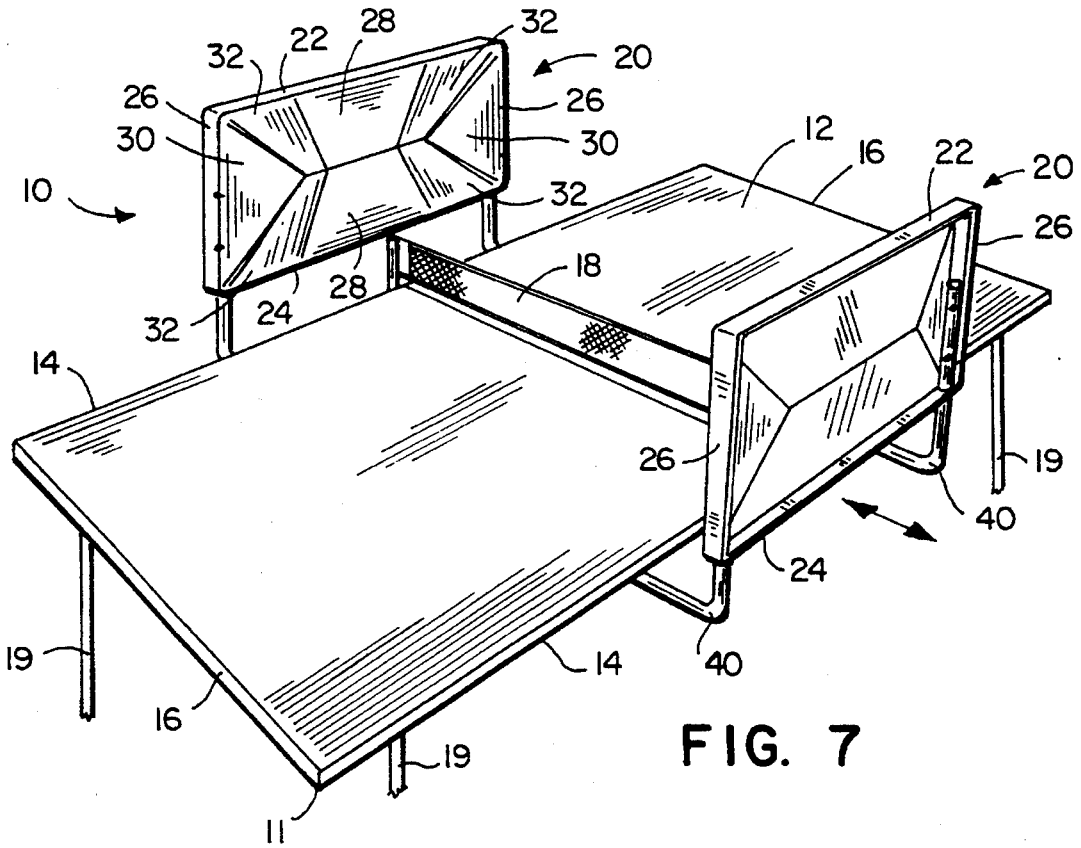
FIG. 7 is a perspective view of the table tennis game, showing the rebounding panels adjustably mounted to the table.
Figure 8:
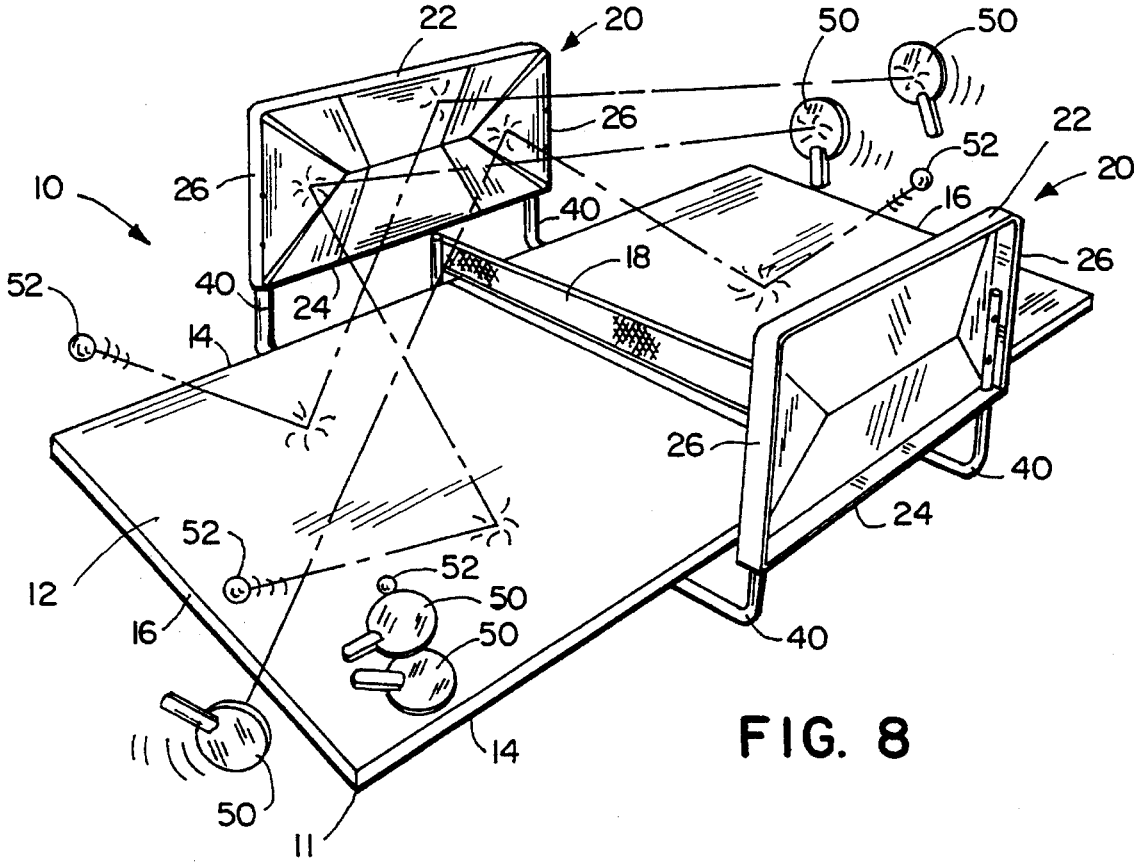
FIG. 8 is a perspective view of the table tennis game, showing various angles of play.

For purposes of description herein, the terms "upper," "lower," "right," "left," "rear," "front," "vertical," "horizontal," and derivatives thereof shall relate to the invention as oriented in FIGS. 7 and 8. However, it is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

In the preferred embodiment, a table tennis game is provided, shown generally in FIGS. 1–3 and 7–9 and depicted by the numeral 10. Game 10 includes one or more vertical rebounding panels 20 mounted along the sides of table 11 to provide an alternate rebounding surface. Each rebounding panel 20 is provided with a plurality of different rebounding surfaces 28, 30, 32, to allow for differing speeds and/or spins of ricochet. Rebounding panel 20 may be either permanently affixed to table 11, may be movably attached to allow for movement of rebounding panel 20 in towards and out from table 11, or otherwise positioned alongside table 11.

Figure 3:
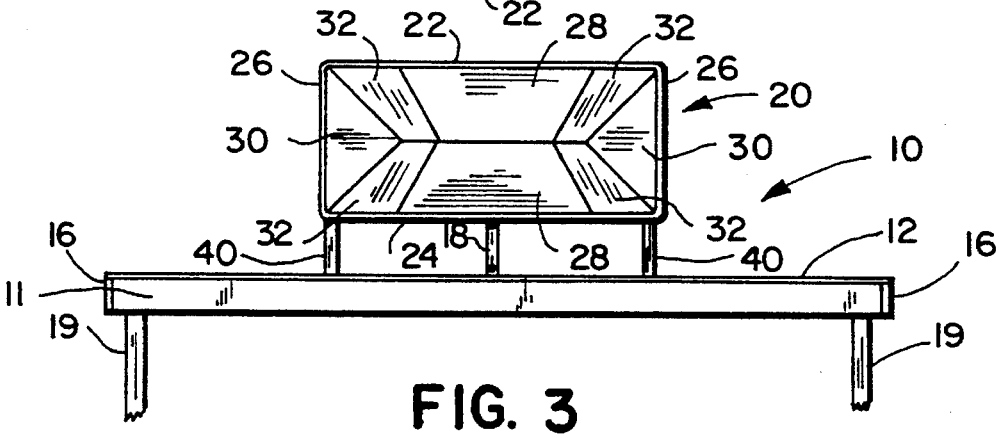
FIG. 3 is a vertical cross-sectional view of the table tennis game, taken generally along the line: III—III of FIG. 1.

Rebounding panel 20 of the present invention is used with a conventional table tennis or Ping-Pong® table 11. Table 11 includes a horizontal playing surface 12, supported at a regular playing height, for example, by a plurality of legs or supports 19, as shown in FIGS. 3 and 7. Horizontal playing surface 12 has four marginal edges, comprising two side edges 14 and two end edges 16. In the typical table tennis game, one or two players stand behind each end edge 16 facing each other. Table 11 may be of any desired size and shape. Horizontal playing surface 12 may be constructed from any suitable material. A net 18 extends across horizontal playing surface 12 from one side edge 14 to the other, usually at a distance halfway between each end edge 16, thereby dividing horizontal playing surface 12 into two opposite fields of play. Net 18 can be of any desired height. A traditional net height is six inches high.

Rebounding panel 20 can be of any size and shape. In the illustrated examples, rebounding panel 20 is rectangular in shape, as shown in FIGS. 3–8, and measures 24 inches by 42 inches. Rebounding panel 20 can be of any suitable base material, such as wood, plastic, or metal. Different ricochet surfaces and/or textures can be applied to this base material. Rebounding panel 20 has a top edge 22, a bottom edge 24, and opposite side edges 26.

Rebounding panel 20 is provided with one or more rebounding surfaces, which as shown in FIGS. 3–8, are depicted by the reference numerals 28, 30, and 32. Although these figures show three rebounding surfaces, this is for illustrative purposes only. Rebounding panel 20 can be provided with as many rebounding surfaces as desired. Each rebounding surface may have different rebounding characteristics, such as different hardnesses, textures, etc., to allow for differing dynamics of ricochet or rebound. These differing dynamics include not only speed but also spin. The surfaces may differ from another with respect to hardness of material used, texture provided to the surface, or both. The types of materials or surfaces used is not critical. Each surface may have a different surface hardness and/or texture than that of the other rebounding surfaces. As an example, first rebounding surface 28 could be a relatively soft surface constructed from a soft rubber or the like with a smooth outer surface. When the ball is hit towards and strikes this surface, much of the ball's force is absorbed by the rubber material, resulting in a somewhat slower speed of rebound or ricochet, with a somewhat increased spin. A player may decide to attempt to hit the ball off of this surface 28 to catch the opposing player off guard, such as when the opposing player is standing some distance from the end edge 14 of table 11. The slower speed effect will cause the ball to land on the opponent's side closer to net 18 making it difficult for the opponent to reach the ball and return it before it boundes a second time. Second rebounding surface 30 could be a harder surface with a rough or textured outer surface, to provide a medium speed of rebound of ricochet, with a more substantial spin on the ball. Any suitable texture may be used, such as grooves, ridges, or raised bumps or protrusions. Alternatively, a rough-sufficed material, such as a sandpaper- or grit-like material, could be used to give a moderate rebound effect. Third rebounding surface 32 would then be a hard, smooth surface, to provide a fast rebound or ricochet effect. For example, third rebounding surface 32 could be constructed of a finished wood, or could be a laminated resinous plastic, or even metal.

In the illustrated examples, at least two such surfaces of differing consistency are provided on each rebounding panel 20. These surfaces serve to increase the skill and dexterity level involved in playing table tennis. If a player decides to utilize a rebounding panel 20 rather than simply hitting the ball directly over the net 18, the player must possess an added level of skill to accurately aim arid hit the ball off the rebounding panel 20, with the attendant risk that the ball might completely miss the rebounding panel 20 and the player will lose a point or lose his or her serve. If the player is successful in hitting the ball towards and off of the rebounding panel 20, the opposing player must not only be prepared to return such a shot, but also the opposing player must anticipate and adjust for the possible rebound or ricochet speed and/or spin at which the ball will travel. If the opposing player is expecting the tall to be returned in the standard over-the-net fashion, and the player instead utilizes a shot off a rebounding panel 20, the opposing player may be caught out of position and unable to return the ball. If the opposing player does anticipate a rebounding panel shot, but miscalculates the rebound effect, that player may again be caught off guard. The opposing player may expect a fast shot off the smooth, hard surface, causing him or her to back away from the table to give as much time and space to return the fast shot. However, his or her opponent may instead hit the ball off the slow, rubber surface, in which case the ball will land close to the net, causing the opposing player to lunge for the ball to return it before it bounces twice. This is but one example of the manner in which the rebounding panel 20 could be exploited during a game. Players with even added dexterity may reach a point where they actually choose and aim for a particular rebounding surface to achieve a precise rebound effect, rather than just randomly using the rebounding panel as an alternative to the shot straight over the net. This provides an increased element of strategy to the traditional table tennis game. All of this provides for a more enjoyable, exciting, and competitive game.

Figure 6:
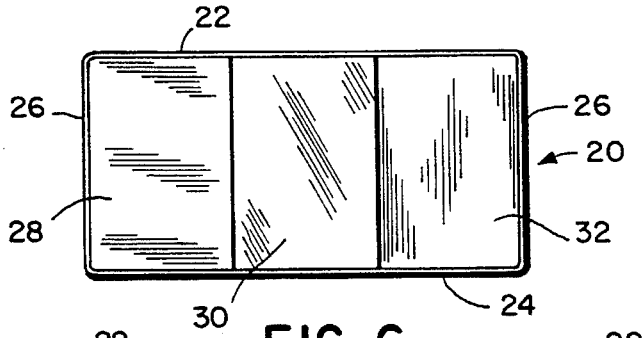
FIG. 6 is an elevation of a second alternate form of the rebounding panel.
Figure 9:
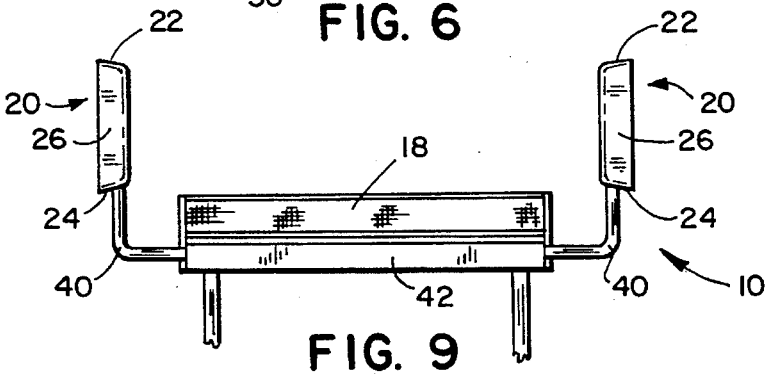
FIG. 9 is an end elevational view of the table tennis game.
Figure 10:
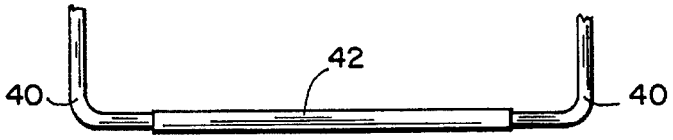
FIG. 10 is a plan view of a receiving member having L-shaped brackets inserted therein.

Rebounding surfaces 28, 30, and 32 may be arranged on rebounding panel 20 in any desired configuration. For example, in FIG. 5, rebounding surfaces 28, 30, and 32 are shown in a horizontal fashion, each panel extending from one side edge 26 to the other. Rebounding surfaces 28, 30, and 32 could also be arranged vertically, as shown in FIG. 6, extending from top edge 22 to bottom edge 24. The rebounding surfaces can also be of any size or shape, and need not be identical to i one and another in size and shape. If desired, the rebounding surfaces could be positioned at various angles with respect to each other, as opposed to lying in a single plane. Such a feature would require even more dexterity in playing the game, as not only the rebound speed and/or spin would be variable, but also the angle at which the ball could potentially ricochet would be uncertain.

Figure 4:
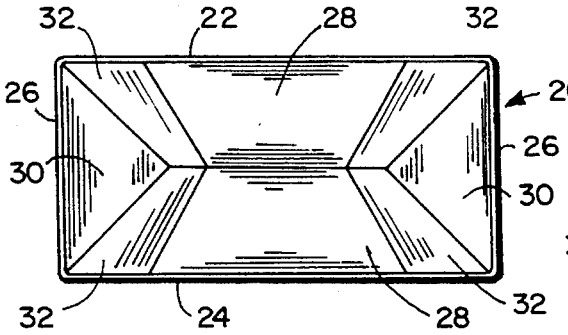
FIG. 4 is a front elevational view of one of the rebounding panels.
Figure 5:
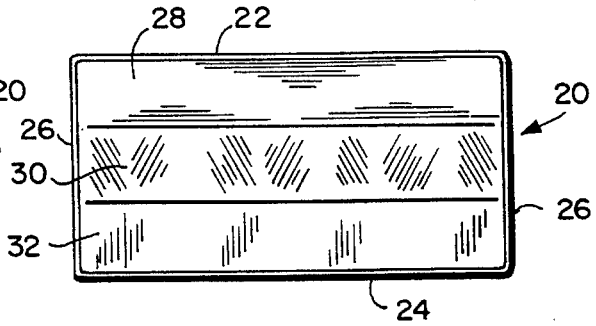
FIG. 5 is an elevation of an alternate form of the rebounding panel.

In one preferred embodiment, rebounding panel 20 is constructed of recessed or tapered sections, as shown in FIGS. 3, 4, 7, and 8. In this embodiment, second rebounding surface 30, the textured surface, consists of two triangular shaped surfaces, each positioned on opposite sides of rebounding panel 20. One side of each triangular surface runs along one of the side edges 26. The other two sides Of the triangle taper in to a point which is centrally positioned between top edge 22 and bottom edge 24. Second rebounding surfaces 30 actually extend in to and are disposed in rebounding panel 20. A seam then runs along a line connecting the recessed points of these two triangular surfaces, along a line which is centrally positioned between top edge 22 and bottom edge 24. First rebounding surface 28, the slow, rubber surface, consists of two surfaces. One surface extends along top edge 22 and tapers downwardly and inwardly, while the other surface extends along bottom edge 24 and tapers upwardly and inwardly. The two surfaces meet and are joined along sides which correspond to the centrally positioned line or seam. First rebounding surfaces 28 are not so large in size that they extend all the way to the triangular-shaped second rebounding surfaces 30, which are on opposite ends of rebounding panel 20. Rather, an area or space remains between each first rebounding surface 28 and each side of the triangular second rebounding surfaces 30. It is in this space where the third rebounding surfaces 32, the hard, smooth surfaces, are positioned. As shown in FIG. 4, there are four of these third rebounding surfaces 32, each of which has one side along top edge 22 (or bottom edge 24), another side adjacent to one of the recessed sides of triangular second rebounding surface 30, a side along the centrally positioned seam, and a side adjacent to one of the tapered sides of first rebounding surface 28. Many possible angles, speeds, and/or spins of rebound or ricochet are provided by the rebounding panel 20 of this configuration. Several such game configurations or angles of play are shown in FIG. 8, where table tennis balls 52 have been struck by paddles 50 and hit towards rebounding panel 20, where they then rebound off of one of the rebounding surfaces 28, 30, or 32 and on to the opposite side of horizontal surface 12 at different angles, due to the tapered or recessed nature of rebounding panel 20 in this embodiment.

Rebounding panel 20 may be positioned at any location along side edge 14 of horizontal playing surface 12. Preferably,i one rebounding panel 20 will be mounted in an upright position centrally along each side edge of a standard table tennis or Ping-Pong® table. In this configuration, one half of rebounding panel 20 is positioned on each side of net 18, as shown in FIG. 3.

Figure 1:
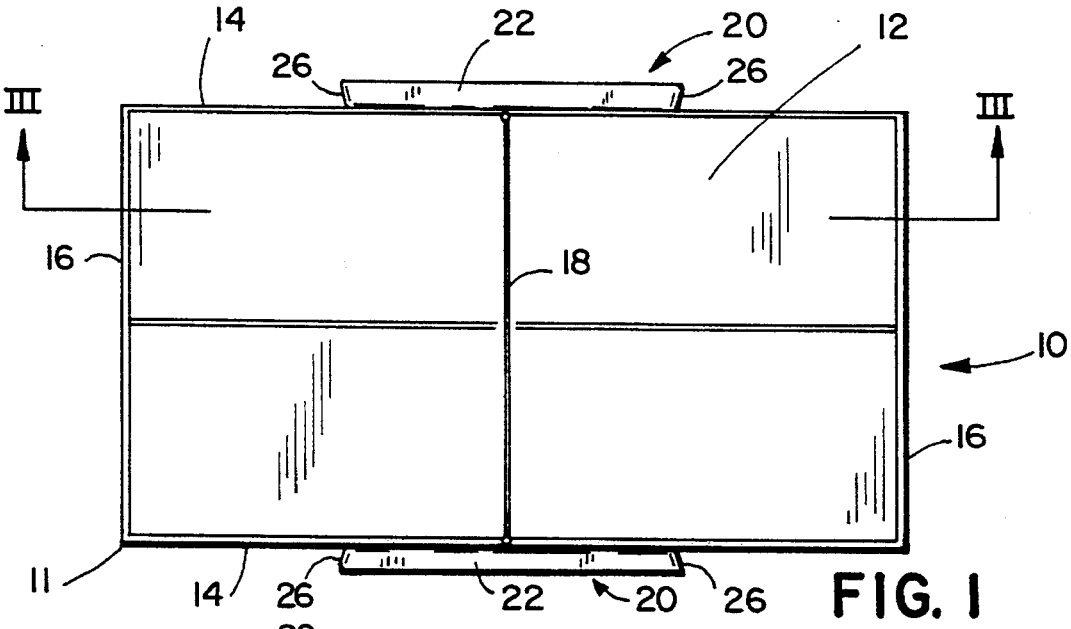
FIG. 1 is a top plan view of a table tennis game in accordance with the present invention, having rebounding panels of the present invention mounted directly on a conventional table.
Figure 2:
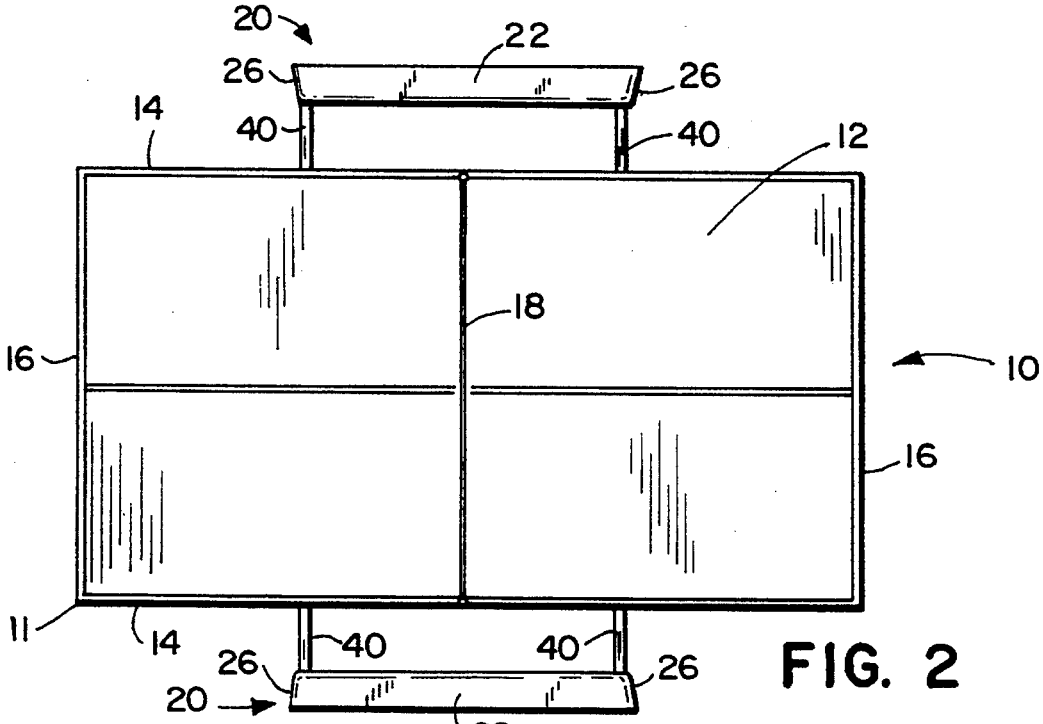
FIG. 2 is a top plan view of the table tennis game, with the rebounding panels being shown shifted laterally away from the side edges of the table.

Rebounding panel 20 may be mounted or attached directly to table 11, as shown in FIG. 1, using any conventional means. For example, a hinge could be used to allow rebounding panel 20 to be retracted down, when it is desired to play a conventional game of table tennis without a rebounding panel blocking the field of play. Alternately, rebounding panel 20 could be bolted, screwed, or nailed directly to table 11. Rebounding panel 20 may also be free standing, and positioned at the desired location about the table.

In the preferred embodiment, rebounding panel 20 is adjustably connected to table 11 to permit rebounding panel 20 to be moved away from table 11 or towards table 11, providing yet .another variation on the traditional table tennis game. This preferred attachment is shown in FIGS. 2, 3, and 7–9. Any suitable means can be employed to achieve this adjustment feature. Most preferably, two L-shaped tubes or brackets 40 are provided, which are each attached at one end to rebounding panel 20. The underside of table 11 is provided with receiving shafts 42, adapted to receive the free ends of L-shaped tubes 40, and positioned at a distance from one another which corresponds to the distance by which L-shaped tubes 40 are separated on rebounding panel 20. Receiving shafts 42 may be fastened to table 11 by any conventional means, such as screws or bolts. Likewise, L-shaped tubes 40 may be attached to rebounding panel 20 using any suitable means. L-shaped tubes 40 can be fastened directly to the outer or back surface of rebounding panel 20, i.e., the surface which is not provided with rebounding surfaces 28, 30, and 32. Alternatively, rebounding panel 20 may be provided along its bottom edge 24 with two holes, through which one end of each L-shaped tube 40 may be inserted and then fastened in place using conventional means. It is preferable to position one shaped tube 40 at or near each side edge 26 of rebounding panel 20.

In operation, rebounding panel 20 having L-shaped tubes 40 fastened thereto is connected to table 11 by lining up the free ends of L-shaped tubes 40 with receiving shafts 42 fastened to the underside of table 11. Rebounding panel 20 is then pushed inward until rebounding panel 20 is at the desired distance from side edge 14 of horizontal playing surface 12. This is preferably done with two rebounding panels 20, one along each side edge 14. Once in place, rebounding panel 20 can be moved into and very close to table 11, or pulled out farther away from table 11. The greater the distance between rebounding panel 20 and table 11, the more skill and dexterity that is necessary to successfully utilize rebounding panel 20 during play. A shot off rebounding panel 20 in an extended position is riskier than when rebounding panel 20 is positioned closer to table 11 or fastened directly to table 11, thus adding an increased element of strategy, with the attendant increases in enjoyment, excitement, and competition.

L-shaped tube 40 is preferably constructed of a sturdy material, such as aluminum metal. Locking means may be provided, such as a thumb screw through a hole in receiving shaft 42, to securely hold L-shaped tube 40 and rebounding panel 20 in place. Alternatively, positioning notches or grooves may be provided along the free end of L-shaped tube 40 to allow movement of rebounding panel 20 to fixed or incremental distances from table 11. This would allow each rebounding panel 20 to be spaced at an equal distance from side edges 14 on each side of horizontal playing surface 12. However, it is not necessary that they be equally spaced. One rebounding panel 20 could be spaced very close to table 11, while the other rebounding panel 20 could be spaced at some distance from table 11, providing participants with even more options in terms of hitting strategies.

In one embodiment of the present invention, the rules of the game require that, with a paddle 50, a server hits the ball 52 on his or her side of horizontal playing surface 12, and then the ball may either cross net 18 directly to the other side or be directed off of rebounding panel 20 and on to the opposing player's field of play. The opposing player may return the ball over net 18 or off rebounding panel 20 without allowing ball 52 to touch his or her side of horizontal playing surface 12, or ball 52 may be permitted to bounce one time before being returned directly over net 18 or off rebounding panel 20 and back to the server. Each volley ends when one player fails to successfully return ball 52 by doing any of the following: hitting ball 52 into net 18; hitting ball 52 over the opposing player's end edge 16 or off of either side edge 14 without ball 52 hitting the opposing player's horizontal playing surface at least once; aiming for and missing rebounding panel 20; or swinging and missing ball 52 completely.

If the server wins the volley, he receives one point and continues to serve. If the opponent wins the volley he receives no points but becomes the server. When one player has reached a set number of points, typically fifteen points with a two-point advantage, the game is over. Players may choose to switch ends half-way through each game or between games.

The above description is considered that of the preferred embodiments only. Modifications of the invention will occur to those skilled in the art and to those who make or use the invention. Therefore, it is understood that the embodiments shown in the drawings and described above are merely for illustrative purposes and are not intended to limit the scope of the invention, which is defined by the following claims as interpreted according to the principles of patent law, including the Doctrine of Equivalents.

The embodiments of the invention in which an exclusive property or privilege is claimed are defined as follows:

1. A table tennis game apparatus, comprising:

a horizontal playing surface having opposite edges extending longitudinally along opposite sides thereof, and being supported at a preselected height to facilitate bouncing an associated ball between opposite fields of play on said playing surface; and at least one rebounding panel positioned alongside of an associated one of the edges of said playing surface to permit the ball to be bounced between said rebounding panel and said playing surface; said rebounding panel having first and second distinct rebounding surfaces oriented toward said playing surface; said first rebounding surface being disposed along a central portion of said rebounding panel, and having an inwardly facing, generally V-shape with a first surface hardness which causes the ball to ricochet at a first speed and/or spin, and said second rebounding surface being disposed along one side of said central portion, and having a second surface hardness, which is different than the first surface hardness of said first rebounding surface, and causes the ball to ricochet at a second speed and/or spin, which is different than said first speed and/or spin for enhanced game enjoyment and competition.

2. A game apparatus as set forth in claim 1, wherein; said first and second rebounding surfaces are oriented at different angles with respect to said playing surface to vary the direction at which the ball ricochets off of said rebounding surfaces.

3. A game apparatus as set forth in claim 2, wherein: said first and second rebounding surfaces have different textures covering said surfaces to vary the speed and/or spin at which the ball ricochets off of said rebounding surfaces.

4. A game apparatus as set forth in claim 3, wherein: said first and second surfaces each extend alongside both of the fields of play on said playing surface.

5. A game apparatus as set forth in claim 4, wherein: said rebounding panel has a generally rectangular front elevational shape.

6. A game apparatus as set forth in claim 5, wherein: said rebounding panel has a third rebounding surface, having a distinct surface hardness, which is different than the first surface hardness of said first rebounding surface and the second surface hardness of said second rebounding surface.

7. A game apparatus as set forth in claim 6, wherein: said third rebounding surface has: a different texture covering said third rebounding surface to vary the speed and/or spin at which the ball ricochets off of said third rebounding surface.

8. A game apparatus as set forth in claim 7, wherein: said first rebounding surface is a rubber material, said second rebounding surface is a material selected from the group consisting of wood, metal, or plastic, and said third rebounding surface is textured.

9. A game apparatus as set forth in claim 5, having: one rebounding panel positioned alongside each edge of said playing surface.

10. A game apparatus as set forth in claim 5, wherein: said rebounding panel is laterally adjustable with respect to said edges of said playing surface, to permit movement of said rebounding panel in towards or away from said playing surface.

11. A game apparatus as set forth in claim 2, wherein said second rebounding surface has a generally triangular shape.

12. A game apparatus as set forth in claim 1, wherein: said first and second rebounding surfaces have different textures covering said surfaces to vary the speed and/or spin at which the ball ricochets off of said rebounding surfaces.

13. A game apparatus as set forth in claim 1, wherein: said first and second surfaces each extend alongside both of the fields of play on said playing surface.

14. A game apparatus as set forth in claim 1, wherein: said rebounding panel has a generally rectangular from elevational shape.

15. A game apparatus as set forth in claim 1, wherein: said first and second rebounding surfaces have generally rectangular front elevational shapes.

16. A game apparatus as set forth in claim 1, wherein: said rebounding panel has a third rebounding surface having a distinct surface hardness, which is different than the first surface hardness of said first rebounding surface and the second surface hardness of said second rebounding surface.

17. A game apparatus as set forth in claim 16, wherein: said third rebounding surface has a different texture covering said third rebounding surface to vary the speed and/or spin at which the ball ricochets off of said third rebounding surface.

18. A game apparatus as set forth in claim 17, wherein: said first rebounding surface is a rubber material, said second rebounding surface is a material selected from the group consisting of wood, metal, or plastic, and said third rebounding surface is textured.

19. A game apparatus as set forth in claim 1, having: one rebounding panel positioned alongside each edge of said playing surface.

20. A game apparatus as set forth in claim 1, wherein: said rebounding panel is laterally adjustable with respect to said edges of said playing surface, to permit movement of said rebounding panel in towards or away from said playing surface.

21. A rebounding panel for table tennis games of the type having a horizontal playing surface on which an associated ball is bounced between opposite fields of play, said rebounding panel having a generally rectangular front elevational shape, said rebounding panel further having a top, a bottom, and two sides, wherein said rebounding panel has:

a first rebounding surface, having three sides to from a triangle in shape, one of said sides corresponding to one of said sides of said rebounding panel, the other two sides of said first rebounding surface being recessed into the plane of said rebounding panel to a point which is centrally positioned between said top and said bottom of said rebounding panel;

a second rebounding surface, having three sides to form a triangle in shape, one of said sides corresponding to the side of said rebounding panel opposite said first rebounding surface, said other two sides of said second rebounding surface being recessed into the plane of said rebounding panel to a point which is centrally positioned between said top and said bottom of said rebounding panel, forming a line between the points of said first and second rebounding surfaces which is disposed within the plane of said rebounding surface;

a third rebounding surface, defined by the area between said top of said rebounding panel, said centrally-positioned line, and said first and second rebounding surfaces on one side of said rebounding panel; and a fourth rebounding surface, defined by the area between said bottom of said rebounding panel, said centrally-positioned line, and said first and second rebounding surfaces on opposite sides of said rebounding panel, thereby forming a rebounding panel that is generally trough-shaped.

* * * * *